US007158155B2

(12) United States Patent
Ueda et al.

(10) Patent No.: US 7,158,155 B2
(45) Date of Patent: Jan. 2, 2007

(54) SUBFIELD CODING CIRCUIT AND SUBFIELD CODING METHOD

(75) Inventors: Goro Ueda, Tokyo (JP); Toru Kimura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 371 days.

(21) Appl. No.: 10/185,014

(22) Filed: Jul. 1, 2002

(65) Prior Publication Data

US 2003/0001872 A1 Jan. 2, 2003

(30) Foreign Application Priority Data

Jun. 29, 2001 (JP) ..... 2001-198614

(51) Int. Cl.
*G09G 5/10* (2006.01)

(52) U.S. Cl. ..... 345/690

(58) Field of Classification Search ..... 345/89, 345/148, 60, 690, 689, 153, 147, 553, 699, 345/582, 687; 348/687, 910, 699; 395/800, 395/595; 358/426; 714/724
See application file for complete search history.

(56) References Cited

U.S. PATENT DOCUMENTS 5,051,929 A * 9/1991 Tutt et al. ..... 345/593
5,245,441 A * 9/1993 Ruben ..... 382/235
5,502,462 A * 3/1996 Mical et al. ..... 345/553
5,581,778 A * 12/1996 Chin et al. ..... 712/16
5,596,583 A * 1/1997 Krenik et al. ..... 714/724
6,052,112 A * 4/2000 Tanaka et al. ..... 345/596
6,097,368 A * 8/2000 Zhu et al. ..... 345/601
6,100,939 A * 8/2000 Kougami et al. ..... 348/687
6,333,766 B1 * 12/2001 Kougami et al. ..... 348/687
6,340,961 B1 * 1/2002 Tanaka et al. ..... 345/63
6,661,470 B1 * 12/2003 Kawakami et al. ..... 348/699
6,717,558 B1 * 4/2004 Weitbruch et al. ..... 345/63
6,850,243 B1 * 2/2005 Kilgariff et al. ..... 345/582
2002/0018032 A1 * 2/2002 Weitbruch et al. ..... 345/60

FOREIGN PATENT DOCUMENTS

EP 0890941 A1 * 1/1999
JP 6-276540 A 9/1994
JP 8-56292 A 2/1996
JP 10-124001 A 5/1998
JP 2000-98959 A 4/2000

* cited by examiner

*Primary Examiner*—Bipin Shalwala
*Assistant Examiner*—Prabodh Dharia
(74) *Attorney, Agent, or Firm*—Sughrue Mion, PLLC

(57) ABSTRACT

A subfield coding circuit which subfield-converts R, G, and B image data for producing subfield-converted image data, includes (a) a multiplexer which multiplexes R, G, and B image data, (b) a memory such as a static random access memory (SRAM), including a single lookup table through which the R, G, and B image data is converted into subfield-coded data in time-division, and (c) a demultiplexer which demultiplexes the subfield-coded data to output subfield-coded R, G, and B image data.

13 Claims, 6 Drawing Sheets

SUBFIELD CODING CIRCUIT AND SUBFIELD CODING METHOD

BACKGROUND OF THE INVENTION

1. Field of the Invention

The invention relates to a subfield coding circuit and a subfield coding method for converting R, G, and B image data into subfield-coded data in a plasma display panel.

2. Description of the Related Art

One of important characteristics required for a terminal unit such as a computer to have is a characteristic of displaying gradation.

In a display unit such as a cathode ray tube (CRT) which can be controlled in its operation in analogue manner, it would be possible to control an electron beam current by applying a voltage of an input signal to a grid without deforming a waveform of the voltage. Since a brightness is defined by an intensity of an electron beam current, it would be possible to continuously control gradation.

In a display unit which displays images in binary code, such as a plasma display unit which display images by means of memory effect, gradation is displayed in a particular way.

Hereinbelow is explained the above-mentioned particular way in which gradation is displayed in a plasma display unit.

For instance, it would be possible in a printer to apparently increase a number of gradation by means of error diffusion. However, the error diffusion is accompanied with a problem of little practicability, because it would be necessary to fabricate a cell having high definition, if both of desired gradation and desired resolution were to be accomplished.

In a display unit which displays images in a binary code, a subfield process is usually carried out for displaying images. A subfield process is applicable to a display unit having a high response speed, such as a plasma display unit. In a subfield process, an image signal is quantized or converted into a digital form from an analogue form, and then, data about obtained one field is displayed in time division in each of gradation bits.

In a subfield process, one field period is divided into a plurality of segmented fields each of which is called "subfield" and each of which weighted by the number of light emission in association with each of gradation bits. Then, images are successively reproduced by means of the thus obtained subfields, and images across one field are accumulated by visual integration effect. This results in images having natural intermediate gradation.

For instance, when an image is to be displayed in sixty-four gradation in a subfield process, an analogue image signal input into a display unit is quantized or analogue-to-digital converted into a brightness signal having six bits in association with gradation brightness data in which a brightness is different twice in a level from others.

The thus quantized image signal data is accumulated in a frame buffer memory. Assuming that the most significant bit (MSB) which means a bit having the highest brightness is represented as B1, and bits having lower brightness than the most significant bit are represented as B2, B3, B4, B5 and B6, a brightness ratio among those bits is represented as 32:16:8:4:2:1. Each of pixels selects one of those bits, and resultingly, an image can be displayed in sixty four gradation, that is, in the level of brightness 0 to brightness 63.

Hereinbelow is explained a subfield process, for instance, in AC type color plasma display unit in which scanning electrodes and sustaining electrodes are driven independently of each other, with reference to FIG. 1A.

One field is usually designed to be about one sixtieth in order to avoid flickers from appearing. As illustrated in FIG. 1A, one field is divided into six subfields, a first subfield SF1 to a sixth subfield SF6, each comprised of a scanning period and a charging period.

In a scanning period of the first subfield SF1, data is written into each of pixels in accordance with data about the uppermost bit B1. After data has been written into all pixels, a charge pulse is applied entirely to a panel for causing pixels into which data has been written, to emit a light.

Then, pixels are driven in the second subfield SF2 and the subsequent subfields SF3 to SF6 in the same way as the first subfield SF1.

In order to ensure a sufficient brightness, for instance, 256, 128, 64, 32, 16 and 8 pulses are applied to a panel for light emission in each of charging periods in the first to sixth subfields SF1 to SF6, respectively.

Pixels are driven substantially in the same way as mentioned above also in a process in which a scanning step and a charging step are carried out in combination, as illustrated in FIG. 1B, and in a process in which a scanning step and a charging step are successively carried out in combination across fields.

The reason of selecting a subfield process is necessity of modulating a brightness of an emitted light and the number of light emission with a period of time in which a light is emitted. In order to carry out scanning a plurality of times in one field, it is necessary to scan pixels and write data into pixels in a short period of time.

With significant progress in performance of writing data into a plasma display panel, it is now possible to write data in 3 microseconds or smaller. Thus, it is presently possible to display images in full color in 256 gradation by means of eight subfields.

In the above-mentioned subfield process, subfield coding is carried out for charging to sustain image signals.

FIG. 2 is a partial circuit diagram of a conventional subfield coding circuit to carry out subfield coding.

A subfield coding circuit is fabricated as one of circuits constituting a LSI, and, as illustrated in FIG. 2, is comprised of a first static random access memory (SRAM) 51, a second static random access memory 52, and a third static random access memory 53. Each of the first to third SRAMs 51 to 53 is designed to have one port and acts as a memory for carrying out subfield conversion.

The first SRAM 51 includes a look-up table (LUT) for red (R) signals, the second SRAM 52 includes a look-up table for green (G) signals, and the third SRAM 53 includes a look-up table for blue (B) signals. Data about subfield coding is written in advance into each of the first to third SRAMs 51 to 53 from an external memory (not illustrated) such as EEPROM.

As illustrated in FIG. 2, the first to third SRAMs 51 to 53 receive R, G and B image data, respectively. On receipt of the R, G and B image data, an address in the first to third SRAMs 51 to 53 is designated (herein, the address is common to the first to third SRAMs 51 to 53), and resultingly, subfield coding data is read out of each of the look-up tables included in the first to third SRAMs 51 to 53. As a result, subfield conversion is carried out to each of the R, G and B image data.

The thus subfield-converted R, G and B image data is output from the first to third SRAMs 51 to 53, as illustrated in FIG. 2.

The conventional subfield coding circuit illustrated in FIG. 2 is designed to include three look-up tables in association with R, G and B image data in order to carry out subfield conversion. As a result, the conventional subfield coding circuit unavoidably has high capacity as total capacity of the first to third SRAMs 51 to 53 in proportion to the number of look-up tables. This further results in a large size in a LSI including a subfield coding circuit, and an increase in fabrication costs.

Japanese Unexamined Patent Publication No. 6-276540 (A) has suggested a gamma correcting circuit including a first circuit which switches an input port among a first input terminal through which a red signal is input, a second input terminal through which a green signal is input, and a third input terminal through which a blue signal is input, concurrently switches an output port among a first output terminal through which a red signal is output, a second output terminal through which a green signal is output, and a third output terminal through which a blue signal is output, gamma-corrects a signal received through the switched input terminal, in accordance with a coefficient read out of a memory, latching circuits each of which is electrically connected to the first to third output terminals and which latches the input signal for a certain period of time, a clock circuit which transmits a clock signal as a reference signal, and a controller which transmits a control signal at a timing of one-third of the clock signal. The input and output ports in the first circuit are switched in accordance with the control signal transmitted from the controller. Each of the latching circuits latches the input signals until a signal is input into a final latching circuit. When a signal is input into the final latching circuit, each of the latching circuits all transmit signals.

Japanese Unexamined Patent Publication No. 8-56292 (A) has suggested an image processor which converts an input color image signal in a certain color space into an output color image signal in another color space, and outputs the converted color image signal. The image processor is comprised of tables each associated with each of colors in the output color image signal, and each used for converting the input color image signal into color data of the output color image signal, a data selector which repeatedly selects data associated with a color of the output color image signal, from the tables, and a color converter which converts the input color image signal into the output color image signal by means of data selected by the data selector.

Japanese Unexamined Patent Publication No. 10-124001 (A) has suggested a method of displaying gradation in a display unit, including the steps of dividing one field period into a plurality of subfields having a relative brightness ratio different from one another, and displaying an image having gradation in accordance with combination of brightness of each of the subfields. Assuming that the number of all gradation bits is equal to N wherein N is a positive integer equal to or greater than three, a subfield of a M-th gradation bit is arranged almost at the center of a time axis in all subfield periods. Herein, M is a positive integer, indicates an uppermost bit when M is equal to one, and is equal to or smaller than N. A subfield of at least two gradation bits among gradation bits other than the above-mentioned M-th gradation bit is divided into subfields presenting almost the same light-emission brightness, and the thus divided subfields are arranged at opposite sides of the subfield associated with the M-th gradation bit, in linear symmetry about the time axis.

Japanese Unexamined Patent Publication No. 2000-98959 (A) has suggested a display unit which divides a field into a plurality of subfields, and displays gradation by emitting a light and stopping light emission in a display period in each of the subfields. The display unit is comprised of first means for assigning optimal light-emission pattern to each of the subfields in order to suppress generation of pseudo-frame, based on data about image signals in a field period, and second means for converting image signals into light-emission pattern data in accordance with a control signal transmitted from the first means.

SUMMARY OF THE INVENTION

In view of the above-mentioned problems in the conventional subfield coding circuit, it is an object of the present invention to provide a subfield coding circuit which can prevent an increase in capacity of memories such as SRAMs constituting a subfield coding circuit, and further prevent an increase in a chip size of a LSI including the subfield circuit.

It is also an object of the present invention to provide a subfield coding method which can do the same.

In one aspect of the present invention, there is provided a subfield coding circuit which subfield-converts R, G, and B image data for producing subfield-converted image data, including (a) a multiplexer which multiplexes R, G, and B image data, (b) a memory including a single lookup table through which the R, G, and B image data is converted into subfield-coded data in time-division, and (c) a demultiplexer which demultiplexes the subfield-coded data to output subfield-coded R, G, and B image data.

For instance, the memory may be comprised of a static random access memory (SRAM).

In the subfield coding circuit in accordance with the present invention, R, G and B image data are input into the multiplexer prior to being subfield-converted, and multiplexed. The thus multiplexed R, G and B image data are stored in the memory, and then, converted into subfield-coded data in turn in time division. The thus subfield-converted R, G and B image data are output from the memory in multiplexed form, and then, input into the demultiplexer. The subfield-converted R, G and B image data are demultiplexed in the demultiplexer, and then, output from the demultiplexer.

As mentioned above, though a conventional subfield coding circuit was necessary to include three look-up tables, the subfield coding circuit in accordance with the present invention makes it possible to reduce the number of requisite look-up tables to one from three, because subfield conversion of R, G, and B image data is carried out in time division in a single look-up table. As a result, the subfield coding circuit in accordance with the present invention prevents an increase in capacity of a memory constituting a subfield coding circuit. Specifically, the present invention can reduce a memory capacity down to one-third of a capacity of a memory used in a conventional subfield coding circuit.

In the present invention, it is not necessary to carry out subfield coding in R, G and B image data independently of one another, and subfield coding may be carried out commonly to R, G and B image data. Accordingly, subfield coding may be carried out to R, G and B image data by means of a single look-up table by carrying out subfield data conversion at a data rate three times greater than a data rate of input R, G and B image data.

In another aspect of the present invention, there is provided a subfield coding method for subfield-converting R, G, and B image data to produce subfield-converted image data, including the steps of (a) multiplexing R, G, and B image data, (b) converting the thus multiplexed R, G, and B image data into subfield-coded data in time-division, and (c) demultiplexing the subfield-coded data to output subfield-coded R, G, and B image data.

For instance, the step (b) may be carried out by means of a lookup table equipped in a memory.

The above-mentioned method in accordance with the present invention provides the same advantages as the advantages provided by the above-mentioned subfield coding circuit.

In still another aspect of the present invention, there is provided a plasma display panel including a subfield coding circuit which is comprised of (a) a multiplexer which multiplexes R, G, and B image data, (b) a memory including a single lookup table through which the R, G, and B image data is converted into subfield-coded data in time-division, and (c) a demultiplexer which demultiplexes the subfield-coded data to output subfield-coded R, G, and B image data.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENT

A preferred embodiment in accordance with the present invention will be explained hereinbelow with reference to drawings.

Figure 3:
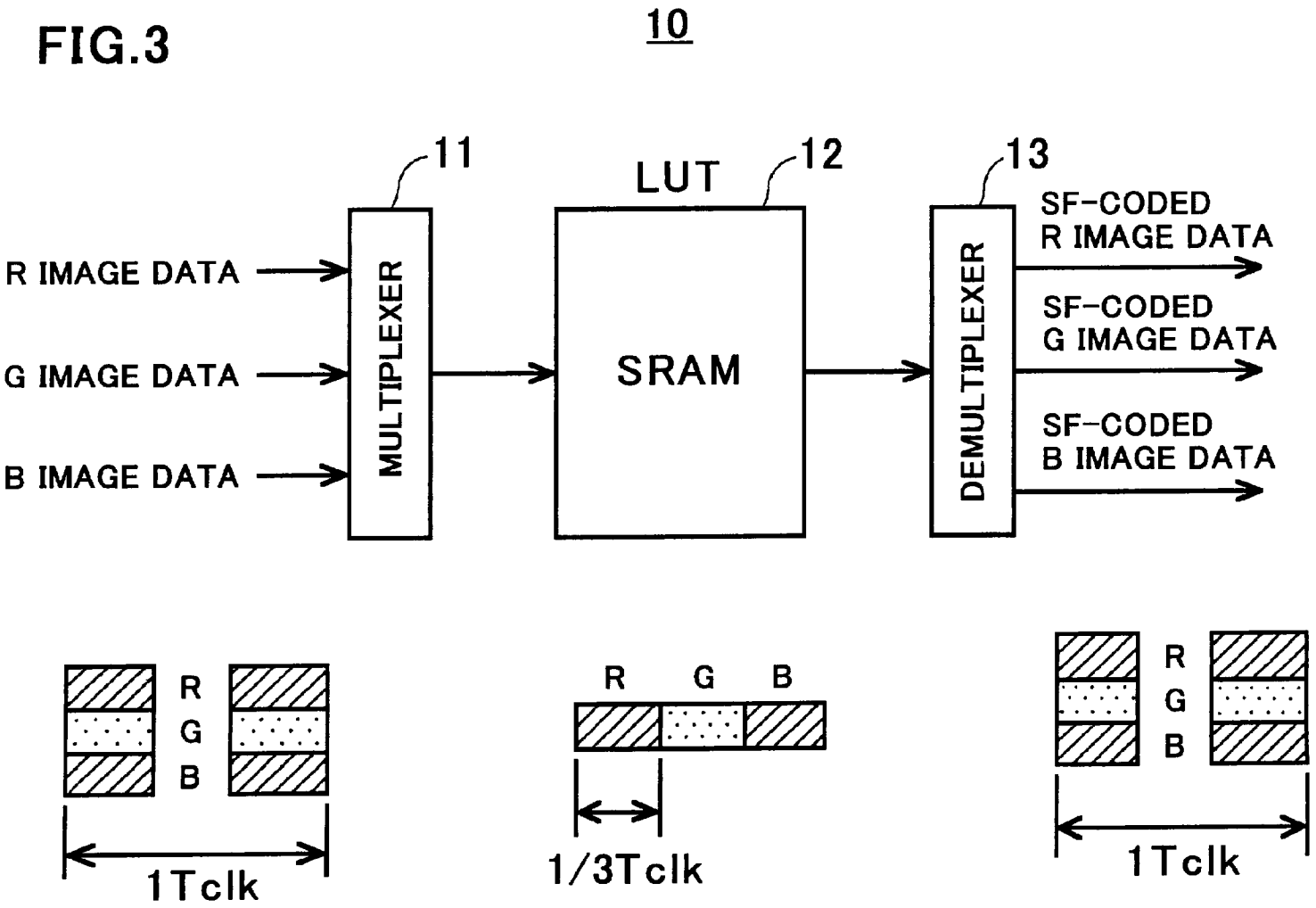
FIG. 3 is a block diagram of a subfield coding circuit in accordance with the embodiment of the present invention.

FIG. 3 is a block diagram of a subfield coding circuit in accordance with the embodiment of the present invention.

The subfield coding circuit 10 in accordance with the embodiment is comprised of a multiplexer 11 which receives R, G and B image data and multiplexes the received R, G and B image data, a memory 12 including a single look-up table, which receives R, G and B image data from the multiplexer 11, and subfield-codes the received R, G and B image data in time division, that is, converts the received R, G and B image data into subfield-coded data in time division, and a demultiplexer 13 which receives the subfield-coded R, G and B image data from the memory 12, demultiplexes the received R, G and B image data, and outputs the subfield-coded R, G and B image data.

In the embodiment, the memory 12 is comprised of a one-port static random access memory (SRAM).

The subfield coding circuit 10 in accordance with the embodiment operates as follows.

The multiplexer 11 receives R, G and B image data, and multiplexes them. As illustrated in FIG. 3, data including R, G and B image data in mixture has a length of 1 Tclk. Herein, Tclk means a reference period of time.

Then, R, G and B image data in multiplexed condition are input into the memory 12. By designating an address in the memory 12 in turn, the R, G and B image data having been input into the memory 12 reads subfield coding data out of the look-up table included in the memory 12. As a result, subfield conversion is carried out to each of the R, G and B image data. That is, each of the R, G and B image data is subfield-coded in this order in time division. In other words, the R, G and B image data are converted into subfield-coded data.

Each of the thus subfield-coded R, G and B image data has a length of ⅓ Tclk. That is, each of the thus subfield-coded R, G and B image data has a data rate which is three times greater than a data rate of the R, G and B image data before subfield-coded.

The thus subfield-coded R, G and B image data in multiplexed condition are output from the memory 12, and input into the demultiplexer 13. The subfield-coded R, G and B image data are demultiplexed in the demultiplexer 13, and output from the demultiplexer 13 separately from one another.

Each of the subfield-converted R, G and B image data has a length of 1 Tclk.

Figure 1A:
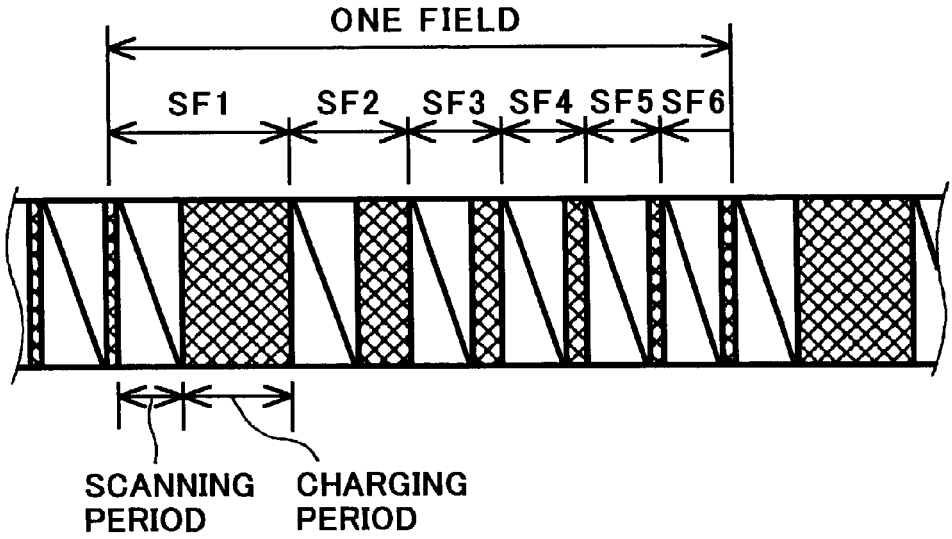
FIG.1A PRIOR ART
FIG. 1A illustrates an example of displaying images in a subfield process.
Figure 1B:
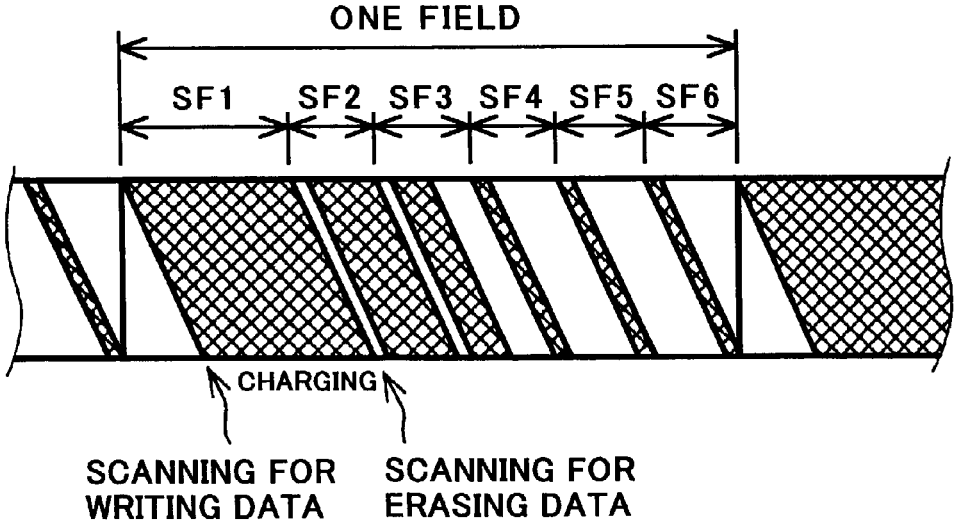
FIG.1B PRIOR ART
FIG. 1B illustrates another example of displaying images in a subfield process.
Figure 2:
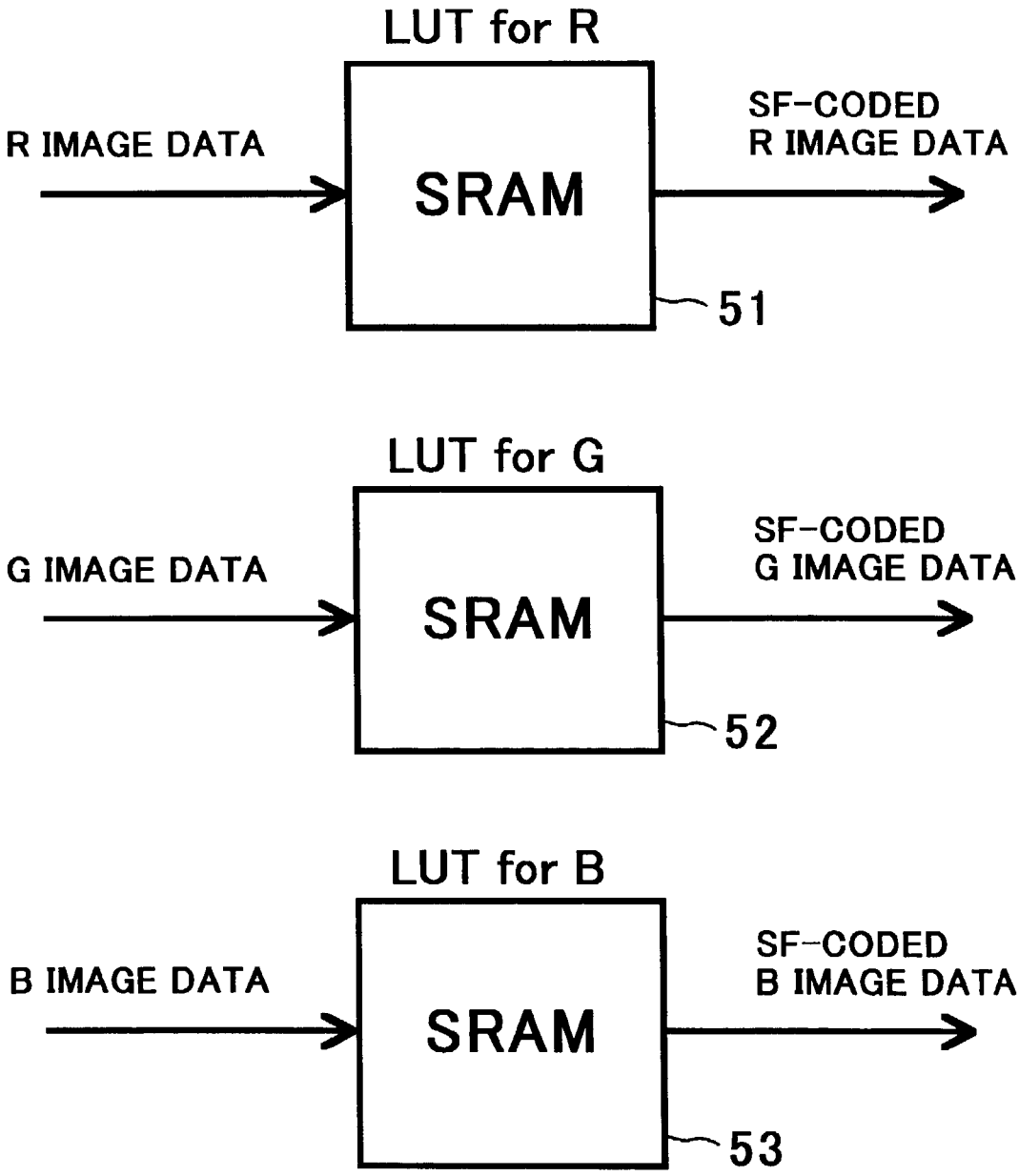
FIG.2 PRIOR ART
FIG. 2 is a partial block diagram of a conventional subfield coding circuit.

As mentioned above, the conventional subfield coding circuit was necessary to include three look-up tables. In contrast, the subfield coding circuit 10 in accordance with the embodiment makes it possible to reduce the number of requisite look-up tables to one from three, because subfield conversion of R, G, and B image data is carried out in time division in the single look-up table. As a result, the subfield coding circuit 10 in accordance with the embodiment prevents an increase in capacity of a memory constituting a subfield coding circuit. Specifically, the subfield coding circuit 10 can reduce a memory capacity down to one-third of a capacity of a memory used in the conventional subfield coding circuit illustrated in FIG. 2. Thus, it would be possible to prevent an increase in a chip size of a LSI including the subfield coding circuit 10 in accordance with the embodiment.

Figure 4:
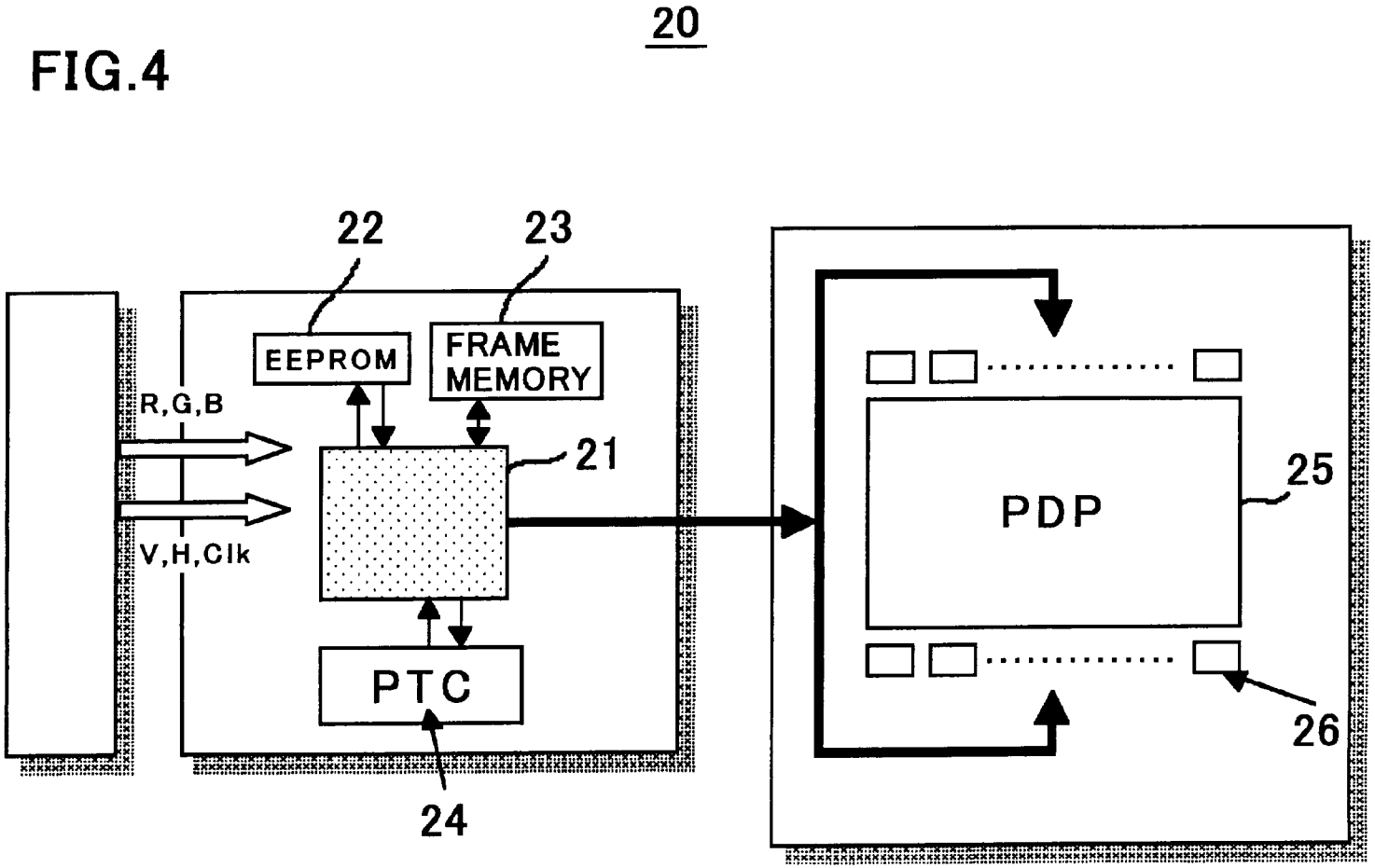
FIG. 4 is a block diagram of a color plasma display panel system including a subfield coding circuit in accordance with the embodiment of the present invention.

FIG. 4 is a block diagram of a color plasma display panel system including the above-mentioned subfield coding circuit 10 in accordance with the embodiment.

The color plasma display panel system 20 illustrated in FIG. 4 is comprised of a LSI 21, an EEPROM 22 storing data used for controlling an operation of LSI 21, a frame memory 23 storing data covering one frame, a plasma timing controller (PTC) 24 controlling an operation of LSI 21, a plasma display panel (PDP) 25, and a plurality of data driver ICs 26 each of which receives a control signal transmitted from LSI 21, and controls the plasma display panel 25 with respect to its light-emission.

The subfield coding circuit 10 in accordance with the above-mentioned embodiment is fabricated as a part of LSI 21.

Figure 5:
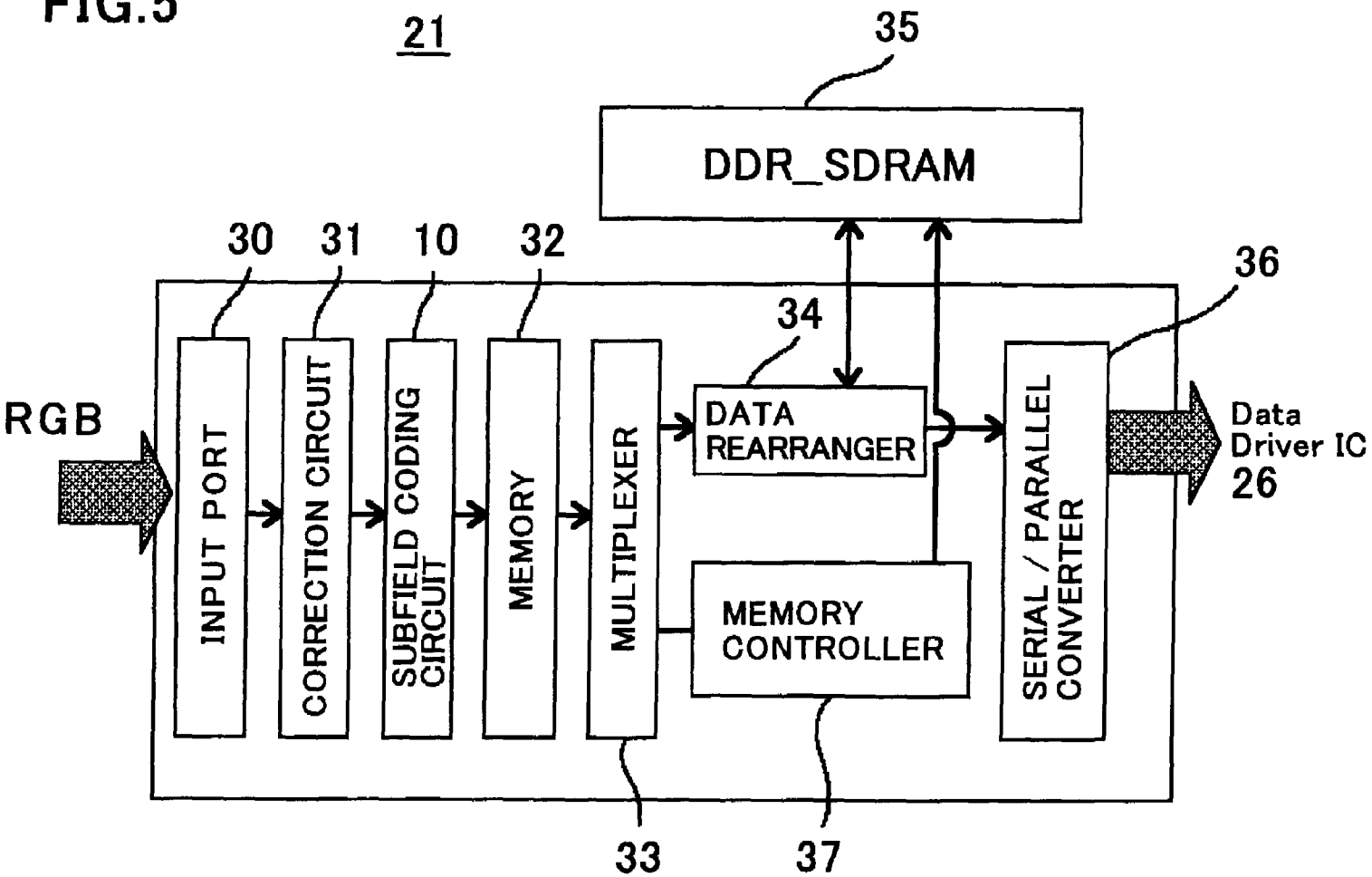
FIG. 5 is a block diagram of a LSI which is a part of the color plasma display system illustrated in FIG. 4.

FIG. 5 is a block diagram of LSI 21.

The illustrated LSI 21 is comprised of an input port 30, a correction circuit 31, the subfield coding circuit 10, a memory 32, a multiplexer 33, a data rearranger 34, a memory controller 37, and a serial/parallel converter 36.

The R, G and B image data signal is received at the input port 30, and is converted into a system clock.

The correction circuit 31 carries out gamma (γ) conversion and color space conversion to the R, G and B image data signal which is in the form of a system clock.

Then, the R, G and B image data signal is subfield-coded in the subfield coding circuit 10 in accordance with the above-mentioned embodiment.

One line of the thus subfield-coded R, G and B image data signal is stored in the memory 32, and then, multiplexed in the multiplexer 33.

A part of the thus multiplexed R, G and B image data signal is rearranged in the data rearranger 34, and then, stored in SDRAM 35 and output to the serial/parallel converter 36.

The rest of the multiplexed R, G and B image data signal is stored in SDRAM 35 through the memory controller 37.

The R, G and B image data signal having been input into the serial/parallel converter 36 is converted into a parallel form from a serial form, and then, output to the data driver ICs 26 illustrated in FIG. 4.

Figure 6:
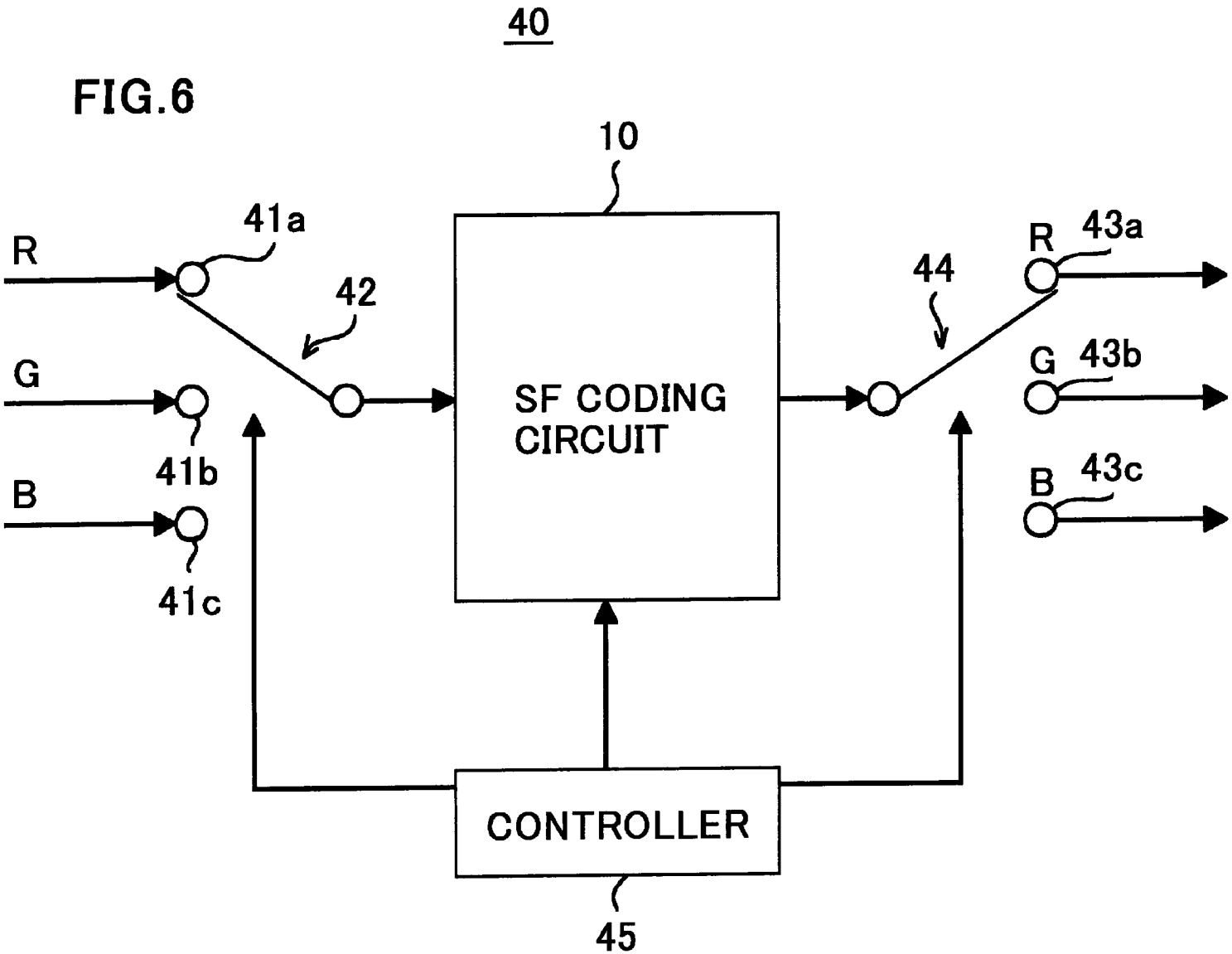
FIG. 6 is a block diagram of a subfield converter including the subfield coding circuit illustrated in FIG. 2.

FIG. 6 is a circuit diagram of an example of a subfield converter 40 including the subfield coding circuit 10 in accordance with the above-mentioned embodiment.

The subfield converter 40 is comprised of the subfield coding circuit 10 in accordance with the above-mentioned embodiment, a first input terminal 41*a* through which R image data signal is received, a second input terminal 41*b* through which G image data signal is received, a third input terminal 41*c* through which B image data signal is received, a first switch 42 which electrically connects one of the first to third input terminals 41*a* to 41*c* to the subfield coding circuit 10, a first output terminal 43*a* through which R image data having been subfield-converted in the subfield coding circuit 10 is transmitted, a second output terminal 43*b* through which G image data having been subfield-converted in the subfield coding circuit 10 is transmitted, a third output terminal 43*c* through which B image data having been subfield-converted in the subfield coding circuit 10 is transmitted, a second switch 44 which electrically connects the subfield coding circuit 10 to one of the first to third output terminals 43*a* to 43*c*, and a controller 45 which controls an operation of the subfield coding circuit 10, the first switch 42 and the second switch 44.

The controller 45 controls the first switch 42 to cause one of the first to third input terminals 41*a* to 41*c* to electrically connect to the subfield coding circuit 10. For instance, if the controller 45 controls the first switch 42 to cause the first input terminal 41*a* to electrically connect to the subfield coding circuit 10, a R image data signal is input into the subfield coding circuit 10 through the first input terminal 41*a*, and then, subfield-converted in the subfield coding circuit 10.

After the R image data signal has been subfield-coded in the subfield coding circuit 10, the controller 45 controls the second switch 44 to cause the subfield coding circuit 10 to electrically connect to the first output terminal 43*a*. Then, the subfield-coded R image data signal is output through the first output terminal 43*a*.

In the same way as mentioned above, the controller 45 controls the first switch 42 to cause the second input terminal 41*b* to electrically connect to the subfield coding circuit 10, and resultingly, a G image data signal is input into the subfield coding circuit 10 through the second input terminal 41*b*, and then, subfield-converted in the subfield coding circuit 10. Then, the controller 45 controls the second switch 44 to cause the subfield coding circuit 10 to electrically connect to the second output terminal 43*b*. Then, the subfield-coded G image data signal is output through the second output terminal 43*b*.

Subsequently, the controller 45 controls the first switch 42 to cause the third input terminal 41*c* to electrically connect to the subfield coding circuit 10, and resultingly, a B image data signal is input into the subfield coding circuit 10 through the third input terminal 41*c*, and then, subfield-converted in the subfield coding circuit 10. Then, the controller 45 controls the second switch 44 to cause the subfield coding circuit 10 to electrically connect to the third output terminal 43*c*. Then, the subfield-coded B image data signal is output through the third output terminal 43*c*.

Hereinbelow is explained an example of subfield coding to be carried out in the subfield coding circuit 10 in accordance with the above-mentioned embodiment.

For instance, if an image is to be displayed in sixty four gradation, first to sixth subfields SF1 to SF6 are set in association with the most significant bit (MSB) B1 to the lowest significant bit (LSB) B6.

Then, each of the subfields associated with gradation bits B2, which is a gradation bit immediately below the most significant bit B1, to the lowest significant bit B6 is divided into two subfields. Specifically, the gradation bit B2 is associated with subfields SF2-1 and SF2-2, the gradation bit B3 is associated with subfields SF3-1 and SF3-2, the gradation bit B4 is associated with subfields SF4-1 and SF4-2, the gradation bit B5 is associated with subfields SF5-1 and SF5-2, and the gradation bit B6 is associated with subfields SF6-1 and SF6-2.

The number of application of light-emission pulses to the thus divided subfields is set equal to almost a half of the number of the same determined before the subfields are divided.

Such division of a subfield as mentioned above may be carried out by repeatedly reading data about B2 gradation bit out of a frame buffer memory, for instance, to the subfields SF2-1 and SF2-2.

In the arrangement of the divided subfields, SF6-1, SF5-1, SF4-1, SF3-1, SF2-1, SF1, SF2-2, SF3-2, SF4-2, SF5-2 and SF6-2, the subfield SF1 is located almost at the center of a field, and the divided subfields SF2-1 and SF2-2 are located at the opposite sides of and adjacent to the subfield SF1. The divided subfields SF3-1 and SF3-2 are located outside and adjacent to the divided subfields SF2-1 and SF2-2. The divided subfields SF4-1 and SF4-2 are located outside and adjacent to the divided subfields SF3-1 and SF3-2. The divided subfields SF5-1 and SF5-2 are located outside and adjacent to the divided subfields SF4-1 and SF4-2. The divided subfields SF6-1 and SF6-2 are located outside and adjacent to the divided subfields SF5-1 and SF5-2.

The arrangement of the divided subfields as mentioned above ensures that a center of a period of time in which light emission is conducted in all of the gradation bits is common, and hence, symmetric property is ensured.

The above-mentioned arrangement requires eleven subfields. If those eleven subfields could be terminated within a certain period of time in one field period, it would be possible to eliminate moving-picture pseudo-frame which is unpreferably caused when gradation is displayed in accordance with a subfield process.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2001-198614 filed on Jun. 29, 2001 including specification, claims, drawings and summary is incorporated herein by reference in its entirety.

What is claimed is:

1. A subfield coding circuit which subfield-converts R, G, and B image data, comprising:

(a) a multiplexer which multiplexes R, G, and B image data;

(b) a memory including a single lookup table in which subfield-coded data are associated with multiplexed R, G, and B image data, said memory receiving said multiplexed R, G, and B image data from said multiplexer as an address input thereto and reading the associated subfield-coded data indicated by the address from said single lookup table; and (c) a demultiplexer which demultiplexes said subfield-coded data from said memory to output subfield-coded R, G, and B image data.

2. The subfield coding circuit as set forth in claim 1, wherein said memory is comprised of a static random access memory (SRAM).

3. A plasma display panel including a subfield coding circuit which is comprised of:

(a) a multiplexer which multiplexes R, G, and B image data;

(b) a memory including a single lookup table in which subfield-coded data are associated with multiplexed R, G, and B image data, said memory receiving said multiplexed R, G, and B image data from said multiplexer as an address input thereto and reading the associated subfield-coded data indicated by the address from said single lookup table; and (c) a demultiplexer which demultiplexes said subfield-coded data from said memory to output subfield-coded R, G, and B image data.

4. The plasma display panel as set forth in claim 3, wherein said memory is comprised of a static random access memory (SRAM).

5. A subfield coding method for subfield-converting R, G, and B image data, comprising the steps of:

(a) multiplexing R, G, and B image data;

(b) receiving said multiplexed R, G, and B image data as an address input to a memory including a single lookup table in which subfield-coded data are associated with multiplexed R, G, and B image data;

(c) converting said multiplexed R, G, and B image data into subfield-coded data in time-division by reading associated subfield-coded data indicated by the address from said single lookup table included in said memory; and (d) demultiplexing said subfield-coded data to output subfield-coded R, G, and B image data.

6. The subfield coding method as set forth in claim 5, wherein said memory is comprised of a static random access memory (SRAM).

7. A subfield coding circuit, comprising:

a multiplexer which multiplexes first image data and second image data to produce multiplexed data; and a memory circuit including a single lookup table in which subfield-coded data are associated with multiplexed data, said memory circuit receiving the multiplexed data from said multiplexer as an address input thereto and reading the associated subfield-coded data indicated by the address from said single lookup table; and a demultiplexer which demultiplexes said subfield-coded data into subfield-coded first data and subfield-coded second data.

8. The subfield coding circuit as claimed in claim 7, wherein the first image data and the second image data comprise two of red image data, green image data, and blue image data.

9. A subfield coding circuit, comprising;

a multiplexer which multiplexes first image data, second image data, and third image data to produce multiplexed data;

a memory circuit including a single lookup table in which subfield-coded data are associated with multiplexed data, said memory circuit receiving the multiplexed data from said multiplexer as an address input thereto and reading the associated subfield-coded data indicated by the address from said single lookup table; and a demultiplexer which demultiplexes said subfield-coded data into the subfield-coded first data, subfield-coded second data, and subfield-coded third data.

10. The subfield coding circuit as claimed in claim 9, wherein the first image data corresponds to red image data, wherein the second image data corresponds to green image data, and wherein the third image data corresponds to blue image data.

11. The subfield coding circuit as claimed in claim 9, wherein a period of a portion of the multiplexed data corresponding to the first image data is less than a period of the first image data.

12. The subfield coding circuit as claimed in claim 9, wherein the period of the portion of the multiplexed data corresponding to the first image data is one-third of the period of the first image data.

13. The subfield coding circuit as claimed in claim 9, wherein a sum of periods of the multiplexed data corresponding to the first image data, the second image data, and the third image data equals a period of the first image data.

* * * * *